US006256466B1

(12) United States Patent
Ota et al.

(10) Patent No.: US 6,256,466 B1
(45) Date of Patent: Jul. 3, 2001

(54) DEVELOPING DEVICE CAPABLE OF PREVENTING TONER PARTICLES FROM BEING ACCUMULATED AT A FRONT END OF A COVER MEMBER

(75) Inventors: Katsuya Ota; Masahiko Kobayashi, both of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/522,000

(22) Filed: Mar. 9, 2000

(30) Foreign Application Priority Data

Mar. 16, 1999 (JP) ..... 11-070951

(51) Int. Cl.[7] ..... G03G 15/06
(52) U.S. Cl. ..... 399/103
(58) Field of Search ..... 399/102, 103, 399/105, 270, 285, 252

(56) References Cited

U.S. PATENT DOCUMENTS

| | | | | |
|---|---|---|---|---|
| 4,338,880 | * | 7/1982 | Tabuchi et al. | 399/103 |
| 4,387,982 | * | 6/1983 | Stanley | 399/103 |
| 4,592,653 | * | 6/1986 | Ikeda et al. | 399/103 |
| 4,697,914 | * | 10/1987 | Hauser | 399/104 |
| 4,792,831 | * | 12/1988 | Takeda et al. | 399/105 |
| 5,044,313 | * | 9/1991 | Yuge et al. | 399/103 |
| 5,640,648 | * | 6/1997 | Komakine et al. | 399/103 |

FOREIGN PATENT DOCUMENTS

| | | | |
|---|---|---|---|
| 58-100345 | | 7/1983 | (JP) . |
| 60-69665 | | 4/1985 | (JP) . |
| 62-58464 | | 4/1987 | (JP) . |
| 63-146068 | | 6/1988 | (JP) . |
| 5-249823 | | 9/1993 | (JP) . |
| 11-265118 | * | 9/1999 | (JP) . |

OTHER PUBLICATIONS

Copy of (translated) JPO Official Action dated Dec. 19, 2000; reference No. 54–00068.

* cited by examiner

*Primary Examiner*—Sophia S Chen
(74) *Attorney, Agent, or Firm*—Smith, Gambrell & Russell, LLP

(57) ABSTRACT

A developing device 3 has a cover member 14 for covering an upper part of a developing roller 11. A seal 16 at a front end of the cover member 14 is brought into contact with a peripheral surface of a photosensitive drum 1. When toner particles are accumulated in the vicinity of a front end of the seal 16, the toner particles adhere to the photosensitive drum1, so that an undesirable black strip appears. Therefore, a voltage in a range from a developing bias to a potential at which the photosensitive drum 1 is charged is applied to a cover plate 15 of the cover member 14. The seal 16 is at a high potential which is the same in polarity as the potential at which the photosensitive drum 1 is charged. Accordingly, no toner particles are accumulated at a front end of the seal 16, so that no black stripe appears.

6 Claims, 1 Drawing Sheet

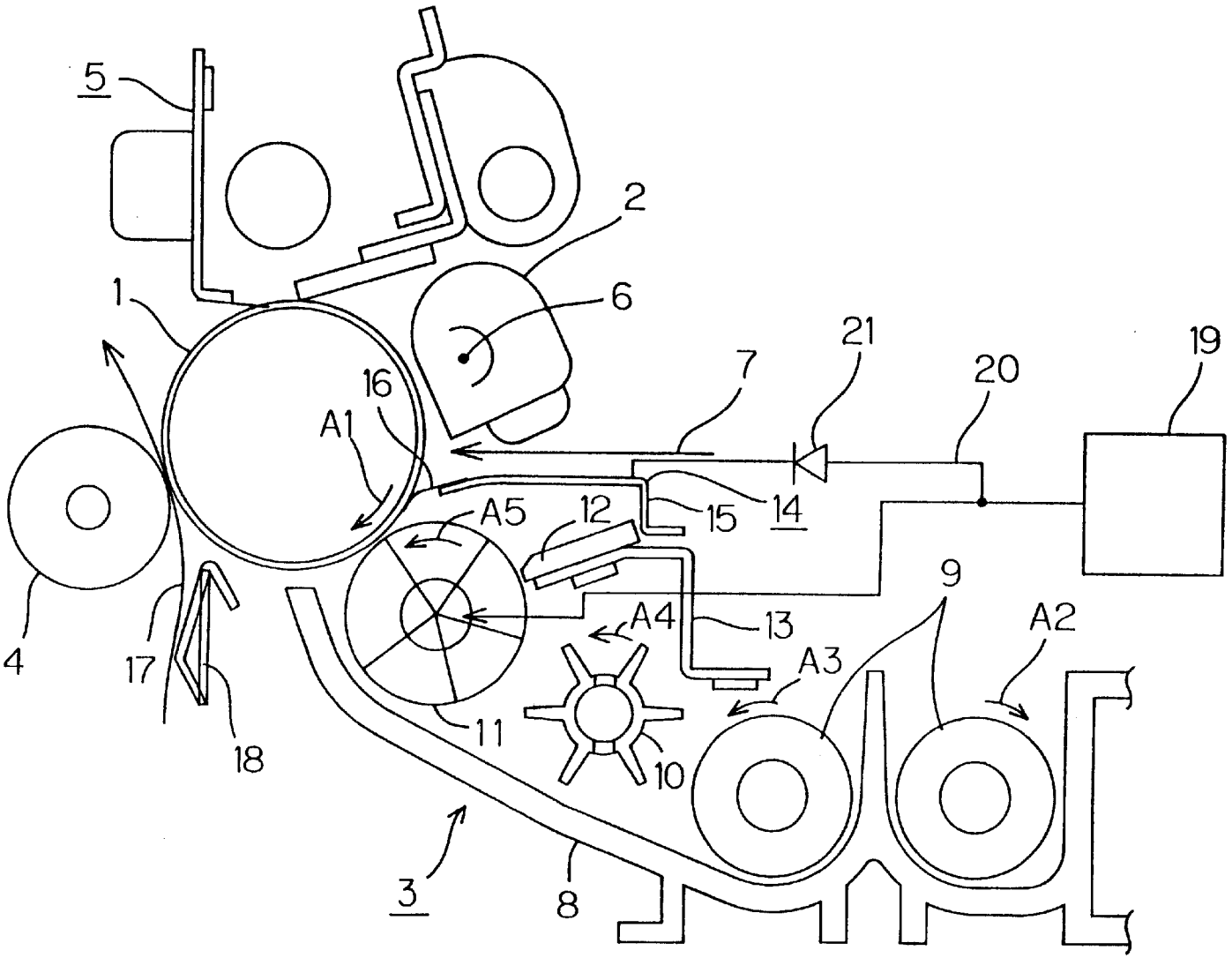
19
20
21
7
14
15
2
6
16
A1
A5
12
A4
13
A3
9
A2
10
11
8
3
5
1
4
17
18

DEVELOPING DEVICE CAPABLE OF PREVENTING TONER PARTICLES FROM BEING ACCUMULATED AT A FRONT END OF A COVER MEMBER

This application is based on an application No. 11-70951 filed in Japan, the content of which is incorporated hereinto by reference.

BACKGROUND OF THE INVENTION

1. Field of the Invention

The present invention relates to an image forming apparatus for developing by toner particles an electostatic latent image formed by an electrophotographic system.

2. Description of the Related Art

When an electrostatic latent image formed on the surface of a photosensitive drum is developed by toner particles, to transfer the toner image on paper, a black stripe may appear on the paper, and the contour of an image in a solid portion may be slightly distorted.

When the cause thereof is investigated, it is considered that the toner particles are accumulated at a front end of a cover member disposed on the upstream side in the direction of rotation of a developing roller provided in a developing device, and the accumulated toner particles adhere to the surface of the photosensitive drum.

On the other hand, the cover member in the developing device is a member required to prevent the toner particles supplied to the photosensitive drum from the developing roller from being scattered to the peripheries of the developing device and the photosensitive drum. Accordingly, the cover member cannot be omitted to prevent the toner particles from being accumulated at the front end of the cover member.

SUMMARY OF THE INVENTION

Under such a background, the inventors of the present invention have created an image forming apparatus capable of forming a good image by preventing toner particles from being accumulated at a front end of a cover member.

An object of the present invention is to provide an image forming apparatus capable of forming a sharp and clear image which is not distorted and has no unnecessary black stripe.

Another object of the present invention is to provide an image forming apparatus in which unnecessary toner particles are not accumulated in a cover member in a developing device.

In an image forming apparatus comprising a photosensitive drum and a developing device, the present invention employs the following construction for the developing device.

A developing device has a housing, and a developing roller whose surface is partially exposed from the housing, the exposed surface being arranged opposite to the surface of the photosensitive drum. A cover member in contact with the surface of the photosensitive drum is provided on the upstream side of the developing roller, as viewed in the direction of rotation of the photosensitive drum (in other words, as viewed in the direction of rotation of the developing roller). The cover member is at a predetermined potential which is the same in polarity as a potential at which the photosensitive drum is charged.

According to this construction, toner particles are not easily accumulated in the vicinity of the cover member, thereby making it possible to prevent the toner particles from being undesirably moved toward the surf ace of the photosensitive drum from a front end of the cover member.

It is preferable that the cover member has a conductive cover plate, and a non-conductive seal attached to a front end of the cover plate, extending parallel to the axes of the photosensitive drum and the developing roller, and in contact with the surface of the photosensitive drum, and a predetermined voltage is applied to the cover plate so that the non-conductive seal is at a predetermined potential.

In this construction, the non-conductive seal is uniformly kept at a predetermined potential.

A voltage applied to the cover member is preferably an arbitrary potential which is not less than a developing bias applied to the developing roller and is not more than a potential at which the photosensitive drum is charged. More preferably, if a voltage equal to the developing bias is applied to the cover member by a power supply for supplying the developing bias, the construction is simplified.

In this construction, the potential on the cover member does not affect an image on the surface of the photosensitive drum. Moreover, the toner particles are prevented from being drawn to the surface of the photosensitive drum from the cover member, thereby making it possible to improve the developing performance.

The present invention can provide, by not only applying the developing bias to the developing roller as in the conventional example but also causing the cover member, in contact with the peripheral surface of the photosensitive drum in the developing device, other than the developing roller, to be at a predetermined potential which is the same in polarity as the potential at which the photosensitive drum is charged, an image forming apparatus capable of forming a sharp and clear image in which no toner particles are accumulated in the vicinity of a contact between the cover member and the photosensitive drum 1, and no black stripe appears.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a cross-sectional view showing the construction of a principal part of an image forming apparatus according to an embodiment of the present invention.

DESCRIPTION OF THE PREFERRED EMBODIMENTS

FIG. 1 is a cross-sectional view showing the construction of a principal part of an image forming apparatus according to an embodiment of the present invention.

In FIG. 1, a photosensitive drum 1 has an axis of rotation perpendicularly extending, and is rotated at a constant speed in a direction indicated by an arrow A1. A main charger 2, a developing device 3, a transfer roller 4, and a cleaner 5 are arranged in the direction of rotation of the photosensitive drum 1 around the photosensitive drum 1.

The main charger 2 comprises a discharge wire 6 extending parallel to the photosensitive drum 1. By the discharge of the discharge wire 6, a surface, opposite to the wire 6, of the photosensitive drum 1 is charged to +850 V, for example.

A light beam 7 for image formation is emitted from a semiconductor laser (not shown) to a portion between the main charger 2 and the developing device 3. When the surface of the photosensitive drum 1 is irradiated with the light beam 7, charge in an irradiated portion is emitted, so that an electrostatic latent image is formed.

The developing device 3 is a device for developing the electrostatic latent image formed on the surface of the photosensitive drum 1 into a toner image. The developing device 3 comprises a pair of spiral blades 9, a paddle 10, and a developing roller 11 in a housing 8 made of resin. The pair of spiral blades 9 conveys toner particles and carrier particles to the paddle 10 while agitating them, and the paddle 10 agitates the toner particles and the carrier particles and feeds them to the developing roller 11 suitable amounts at a time. The developing roller 11 adsorbs the carrier particles, which the toner particles electrostatically adhere, to its peripheral surface by a magnetic force, and feeds the carrier particles to the photosensitive drum 1. The toner articles and the carrier particles adhere to the surface of the developing roller 11 in a so-called bristling state (a state where they rise radially from the surface of the roller). In order to make the amount of adhesion constant, therefore, there is provided a bristle cutting plate 12. The bristle cutting plate 12 is a plate made of aluminum, for example, and is fixed to a sheet metal plate 13. A cover member 14 is provided in a state where it is electrically insulated from the sheet metal plate 13 and the bristle cutting plate 12. The cover member 14 covers an upper part of the developing roller 11 for preventing the toner particles from being scattered from above the developing roller 11. The cover member 14 has a cover plate 15 made of a metal, and a seal 16 mounted on a front end of the cover plate 15 by being affixed, for example. The seal 16 is a non-conductive flexible thin plate formed of polyurethane resin, for example, and is brought into contact with the surface of the photosensitive drum 1.

The spiral blade 9, the paddle 10, and the developing roller 11 are respectively rotated in directions indicated by arrows A2 to A5. Consequently, the toner particles are supplied to the surface of the photosensitive drum 1, so that the electrostatic latent image on the surface of the photosensitive drum 1 is developed into a toner image.

Paper 17 is conveyed in a direction indicated by its arrow in synchronism with the toner image obtained by the development. When the paper passes between the photosensitive drum 1 and the transfer roller 4, the toner image on the photosensitive drum 1 is transferred onto the paper 17.

The surface of the photosensitive drum 1 on which the toner image has been transferred is opposite to the cleaner 5 and is opposed to the main charger 2 again upon removal of the remaining toner particles.

Reference numeral 18 denotes a paper conveying guide.

A developing bias is applied, as is known, to the developing roller 11 in the developing device 3. The developing bias is a maximum of approximately +650 V, for example. By adjusting the developing bias, the amount of toner supplied to the photosensitive drum 1 is controlled, so that the tone of the toner image to be formed is adjusted.

The present embodiment is characterized in that the same voltage as the developing bias is applied to the cover plate 15 through a power line 20 from a power supply 19 for applying the developing bias.

A voltage is applied to the cover plate 15, to keep the cover member 14 at a predetermined potential under the following background.

When copies are made by the image forming apparatus in a state where the room temperature is 35° C. and the humidity is 85%, a black stripe appears in an image on each of the first to approximately hundredth copies. When the cause thereof is investigated, it has been found that the toner particles are accumulated in the vicinity of the seal 16 of the cover member 14, and the toner particles adhere to the photosensitive drum 1.

It is considered that a voltage is applied to the cover member 14 such that the toner particles are not accumulated in the vicinity of the seal 16.

Various experiments have showed that the potential on the cover plate 15 is the same in polarity as a potential at which the photosensitive drum 1 is charged, and is preferably kept in a range from the developing bias to the potential at which the photosensitive drum 1 is charged.

In the present embodiment, the voltage is applied to the cover plate 15 from the power supply 19 for applying the developing bias. The developing bias is changed in conformity with the surface potential of the photosensitive drum 1, and may, in some cases, be a potential which is opposite in polarity to the surface potential of the photosensitive drum 1. A diode 21 is inserted into the power line 20 such that the potential which is opposite in polarity to the potential on the photosensitive drum 1 is not applied to the cover plate 15.

Although in the present embodiment, the voltage is supplied to the cover plate 15 from the power supply 19 for supplying the developing bias, a dedicated power supply may be provided. Alternatively, a voltage supplied from another power supply may be applied to the cover plate 15.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising a photosensitive drum rotated at a constant speed and having an electrostatic latent image formed on its surface, and a developing device for developing by toner particles the electrostatic latent image formed on the surface of the photosensitive drum, wherein said developing device comprises a housing, a developing roller which is provided in the housing and whose surface is partially exposed from the housing, the exposed surface being arranged opposite to the surface of the photosensitive drum such that the toner particles can be supplied to the photosensitive drum, and a cover member provided on the upstream side of the developing roller, as viewed in the direction of rotation of the photosensitive drum, and in contact with the surface of the photosensitive drum, said cover member being at a predetermined potential which is the same in polarity as a potential at which the photosensitive drum is charged.

2. The image forming apparatus according to claim 1, wherein said cover member has a conductive cover plate, and a non-conductive seal attached to a front end of the cover plate, extending parallel to the axes of the photosensitive drum and the developing roller, and in contact with the surface of the photosensitive drum, and a predetermined voltage is applied to said cover plate so that said non-conductive seal is at said predetermined potential.

3. The image forming apparatus according to claim 2, wherein said cover member is at an arbitrary potential which is not less than a developing bias applied to the developing roller and is not more than the potential at which the photosensitive drum is charged.

4. The image forming apparatus according to claim 3, wherein a voltage equal to the developing bias is applied from a power supply for supplying the developing bias to said cover member.

5. The image forming apparatus according to claim 1, wherein said cover member is at an arbitrary potential which is not less than a developing bias applied to the developing roller and is not more than the potential at which the photosensitive drum is charged.

6. The image forming apparatus according to claim 3, wherein a voltage equal to the developing bias is applied from a power supply for supplying the developing bias to said cover member.

* * * * *